US005377951A

United States Patent [19]

Johnson et al.

[11] Patent Number: 5,377,951

[45] Date of Patent: Jan. 3, 1995

[54] ADJUSTABLE COMPUTER WORKSTATION ASSEMBLY AND METHOD THEREFORE

[75] Inventors: Mack E. Johnson, Arvada; Macy J. Price, Jr., Louisville; Matthew P. Drabczyk, Westminster; Daniel C. Starkey, Englewood; Timothy J. Pickles, Brighton, all of Colo.

[73] Assignee: Engineered Data Products, Inc., Broomfield, Colo.

[21] Appl. No.: 894,742

[22] Filed: Jun. 5, 1992

Related U.S. Application Data

[63] Continuation-in-part of Ser. No. 779,378, Oct. 18, 1991, abandoned.

[51] Int. Cl.[6] ..... A47B 47/02

[52] U.S. Cl. ..... 248/639; 248/918; 248/919; 312/208.1

[58] Field of Search ..... 248/918–920, 248/923, 639, 912, 921, 922, 924; 108/5, 137, 145, 27, 55.3; 312/208.1, 208.2, 208.3

[56] References Cited

U.S. PATENT DOCUMENTS

| | | | |
|---|---|---|---|
| 278,956 | 5/1885 | Gordon | D6/422 |
| 2,982,288 | 5/1961 | Edwards | 108/143 |
| 3,118,172 | 6/1992 | Uglade | 108/137 X |
| 4,590,866 | 5/1986 | Schairbaum | 108/23 |
| 4,625,657 | 12/1986 | Little et al. | 108/93 |
| 4,640,199 | 2/1987 | Zigman | 108/6 |
| 4,644,875 | 2/1987 | Watt | 108/93 |
| 4,691,888 | 9/1987 | Cotterill | 248/284 |
| 4,755,009 | 7/1988 | Price et al. | 312/194 |
| 4,826,123 | 5/1989 | Hannah et al. | 248/248 |
| 4,843,978 | 7/1989 | Schmidt et al. | 108/138 |
| 4,988,066 | 1/1991 | Cotterill | 248/281.1 |
| 5,031,867 | 7/1991 | Cotterill | 248/281.1 |
| 5,037,054 | 8/1991 | McConnell | 248/284 |
| 5,071,204 | 12/1991 | Price et al. | 312/194 |
| 5,205,631 | 4/1993 | Wagman et al. | 312/208.1 X |

FOREIGN PATENT DOCUMENTS

| | | |
|---|---|---|
| 1106895 | 8/1981 | Canada . |
| 3308872 | 12/1983 | Germany . |
| 659370 | 7/1983 | Switzerland . |

*Primary Examiner*—Douglas D. Watts
*Attorney, Agent, or Firm*—Glenn L. Webb

[57] ABSTRACT

A workstation assembly which includes an underdesk monitor support assembly and an underdesk keyboard support assembly. The monitor support assembly and the keyboard support assembly can both be individually adjusted vertically, angularly, and horizontally relative to the workstation. An actuator member for each of the support assemblies allows the support assemblies to be locked into selected vertical and angular positions.

The monitor support assembly and the keyboard support assembly are mounted onto brackets which are easily installed on most desks and counter-type workstations. The workstation assembly can be used in original equipment workstations or installed as a conversion kit.

14 Claims, 16 Drawing Sheets

ADJUSTABLE COMPUTER WORKSTATION ASSEMBLY AND METHOD THEREFORE

BACKGROUND OF THE INVENTION

1. Related Applications

This application is a continuation-in-part of co-pending application Ser. No. 07/779,378, filed on Oct. 18, 1991, now abandoned.

2. Field of the Invention

This invention relates to the field of computer workstations, and particularly to adjustable underdesk monitor workstations.

3. Statement of the Problem

Computer workstations are prevalent for uses requiring high speed information storage, processing and retrieval. Such uses go beyond traditional desk-type environments to counter-style operations, such as in airline counters, department store cashiers, inventory control and the like. Networking between computer users has also increased the utility of computer workstations.

Typically, computer workstations have the computer monitor and the computer keyboard on top of a desk or counter. The computer components are normally too cumbersome to remove from the working area when not in use. This substantially reduces the availability of working space on the desk or counter. The aesthetics of the working environment is also affected by the clutter of the computer equipment and associated cables.

This placement of the computer equipment also reduces the efficiency of the use of the computer. The monitor screen is seldom able to be placed in an unobtrusive location while still able to be comfortably viewed. Thus, the computer operator usually must strain during the operation of the computer to view the monitor. This can lead not only to eye strain but to neck and back strain as well.

The keyboard placement is of even greater concern. Discomfort with keyboard use not only affects the efficiency, but can be related to potentially severe and crippling health problems. Repetitive stress-related injuries, i.e., carpal tunnel syndrome, are becoming more common. One important step in reducing the occurrence of such repetitive stress-related injuries is the ability to randomly adjust the placement of the keyboard. Frequent random adjustment of the keyboard reduces the repetitive motion of the same tendons, muscles, and ligaments of the operator to minimize susceptibility of repetitive stress-related injuries. The present placement of the keyboard and the monitor on the desk or counter surface limits the ability to randomly adjust either unit.

Prior art attempts to remove the computer equipment from the working surface of a workstation are limited to specially designed workstations. One approach, which the present invention utilizes, is to mount the computer monitor and computer keyboard under the working surface of the workstation. One such prior art computer workstation is disclosed in Canadian patent 1,106,895, issued in Aug. 11, 1981. This patent discloses a planar working surface having a transparent portion. A frame is mounted to slide beneath the transparent portion of the working surface. A keyboard support and monitor support are affixed to the frame along with a monitor support. The movable frame provides accessibility to the keyboard. The movable frame also allows the monitor to be viewable through the transparent portion of the working surface. The keyboard support is not adjustable. The monitor support has only limited adjustability.

Another prior art underdesk monitor workstation is disclosed in German patent DE 3308872A1, issued on Sep. 13, 1984. This patent discloses a workstation having a monitor mounted beneath the working surface. The monitor is viewable through an opening in the working surface. The keyboard is placed on the working surface. There is no provision for adjustability of either the monitor or the keyboard.

An adjustable underdesk display workstation is disclosed in U.S. Pat. No. 4,590,866, issued on May 27, 1986. This patent discloses a workstation having a transparent working surface. A monitor display is mounted beneath the transparent working surface to be adjustable from side to side, forward and back, vertically, and angularly, relative to the working surface. The adjustment process requires working beneath the workstation with at least two hands. The keyboard support is not adjustable.

Another prior art workstation using an underdesk monitor is disclosed in U.S. Pat. No. 4,755,009, issued on Jul. 5, 1988. This workstation includes a monitor support mounted on a rolling base frame. The monitor is adjustable vertically, rotationally, and angularly relative to the working surface of the workstation. The monitor adjustment requires at least two hands to perform. The keyboard support is not adjustable.

U.S. Pat. No. 5,071,204, issued on Dec. 10, 1991 also discloses a workstation having an underdesk monitor display. This workstation allows the monitor to be adjusted vertically and angularly between preselected positions. This adjustment requires at least two hands to perform. There is no disclosed adjustable keyboard support.

All of these prior art workstations use specially-designed desks to provide support for an underdesk display monitor. The special design of these desks limit their applications to conventional office-type operations. The prior art workstations are not designed for counter-type operations. These desks typically have limited aesthetic appeal. Further, it may be difficult to incorporate these desks into an existing office or workplace environment.

Although these desks may include some adjustability of the monitors, these adjustments are difficult to perform. Thus, a individual will seldom readjust the monitor after the initial set-up of the desk workstation. This becomes an even greater problem when multiple users utilize a single workstation. The workstations will not comfortably or efficiently accommodate users of differing sizes.

There have also been a number of prior art disclosures of adjustable keyboard supports. One such support is disclosed in U.S. Pat. No. 4,625,657, issued on Dec. 2, 1986. This patent discloses a keyboard support that is adjustable vertically and angularly. The adjustment process uses two levers which operate clamps to lock the keyboard support in a desired position. The keyboard support can be adjusted by a rack and gear teeth mechanism. This adjustment mechanism is not intended for use with an underdesk monitor due to the structure and operation of the adjustment mechanism. This structure also interferes with the viewing of an underdesk monitor. Also, the adjustment process requires one hand to operate the levers and another hand to position the keyboard.

Another prior art adjustable keyboard is disclosed in U.S. Pat. No. 4,644,875, issued on Feb. 24, 1987. This keyboard is angularly adjustable by rotating clamping knobs on both sides of the keyboard support. The adjustment mechanism structure of this keyboard support would also interfere with the viewing and operation of an underdesk monitor. The adjustment process requires two hands to perform as well.

U.S. Pat. No. 4,988,066, issued on Jan. 29, 1991, discloses an adjustable keyboard support that can be adjusted with a one-handed adjustment process. This keyboard support is only adjustable between a few preselected positions. Additionally, the structure of the adjustment mechanism would interfere with the viewing and operation of an underdesk monitor.

A keyboard support disclosed in U.S. Pat. No. 5,037,054, issued on Aug. 6, 1991 is vertically and angularly adjustable. This support requires two hands to adjust. Further, the structure of the adjustment mechanism would interfere with the viewing and operation of an underdesk monitor.

These prior art keyboard supports are adjustable within limited ranges. None of these prior art keyboard supports are able to be infinitely and randomly adjustable by a simple one-handed process. A keyboard user will seldom make the necessary and frequent adjustments to the position of the keyboard if the adjustment process is inconvenient. Additionally, these keyboard supports are not usable with an underdesk monitor workstation.

Thus, a problem exists, in that presently, workstations are limited in the available working space, the adjustability of the position of the computer components, and to their workplace applicability.

Solution to the Problem

The present invention solves these and other problems and achieves an advance in the art by providing an easily adjustable assembly for computer workstations. The adjustable assembly includes an adjustable underdesk monitor support and an adjustable underdesk keyboard support.

The adjustable underdesk monitor support is infinitely and randomly adjustable beneath the working surface of the workstation. The monitor support can be adjusted vertically, angularly, and horizontally relative to the workstation. The adjustment process can be performed easily with only one hand. The monitor support is pivotally mounted on a pair of linkage mechanisms. The monitor support is pivoted about a first axis for vertical adjustment and a second axis for angular adjustment. A roller—bracket mechanism provide horizontal adjustment for the monitor support.

A single actuator member allows the monitor support to be locked into a selected vertical and angular position. The linkage mechanisms include friction washers which are spring biased against the support mechanism to clamp the monitor support in a selected mechanism. The single actuator member includes mating cam surfaces. Rotation of the single actuator member causes the cam surfaces to push against the spring bias. This movement releases the pressure by the friction washers against the monitor support to allow the monitor support to pivot about either or both of the pivot axes. Torsion springs bias the monitor support upward to counterbalance the weight of the monitor.

The adjustable keyboard support includes a similar adjustment mechanism. Thus, the keyboard support can be adjusted horizontally, vertically, and angularly. This allows an operator to frequently and randomly adjust the keyboard position. The adjustment mechanism of the keyboard support does not interfere with the operation and viewing of a monitor mounted on the monitor support. The keyboard support also includes spring-biased detent rollers which engage in notches to lock the keyboard support in a desired horizontal location.

The monitor support and the keyboard support are mounted onto two brackets which are easily installed on most desks and counter-type workstations. The brackets are elongated members having substantially planar mounting surfaces. Indentions are spaced along the elongated members to enable the monitor support and the keyboard support to be affixed to the brackets without protruding through the planar mounting surfaces. Either or both of the monitor support and keyboard support can be secured to the brackets. The brackets can then be mounted by screws to the underside of the working surface of the workstation beneath a viewing opening.

The adjustable workstation assembly can be used in original equipment workstations or installed as a conversion kit. In either installation, the procedure is similar. A template is used to form an opening in the working surface of a workstation. The monitor support and the keyboard support are fastened to the brackets. The brackets are then mounted to the underside of the working surface of the workstation beneath the opening. A transparent panel is then placed in the formed opening to be flush with the working surface.

The monitor support can be easily adjusted so that a monitor on the monitor support can be comfortably viewed through the transparent panel. The operator can easily grasp the monitor support and a lever handle on the actuator member with one hand. The operator rotates the lever handle a quarter turn which causes the cam surfaces to engage to release the pressure on the monitor support. The monitor support is spring biased so that the weight of the monitor does not affect the adjustment process. The monitor support is then moved about the pivot axes to a desired position. Once the monitor is in the desired vertical and angular position, the lever is released. This causes the actuator member to rotate and the frictional pressure against the monitor support to reengage the monitor support. The keyboard support is adjusted in a similar process.

Thus, the present invention provides an adjustable workstation assembly which increases the available working space, the adjustability of the position of the computer components, and the application of computer workstations.

BRIEF DESCRIPTION OF THE DRAWINGS

FIG. 7(*b*) is a front view of the keyboard support assembly in the unclamped position.

FIG. 11(*b*) is a front view of the monitor support assembly in an unclamped position.

FIG. 12(*b*) is a perspective view of the desk of FIG. 12(*a*) with a central opening cut into the desktop.

FIG. 12(*c*) is an exploded view of the workstation assembly of the present invention assembled onto the desk of FIG. 12(*a*).

FIG. 12 (*d*) is a perspective view of the assembled workstation.

DETAILED DESCRIPTION OF THE PREFERRED EMBODIMENTS

The present invention provides an adjustable computer workstation assembly. This workstation assembly includes an underdesk keyboard support and an underdesk monitor support to increase the available working space on the working surface of a workstation. The keyboard support and the monitor support are independently horizontally, vertically, and angularly adjustable. The workstation assembly can be used in desk-type workstations as well as counter-type applications. The underdesk workstation assembly can be supplied as original equipment as well as used to convert existing workstations.

One possible preferred embodiment of the present invention is illustrated in FIGS. 1–14. It is to be expressly understood that this exemplary embodiment is described for explanatory purposes only. This description is not meant to limit the scope of the inventive concept.

Figure 1:
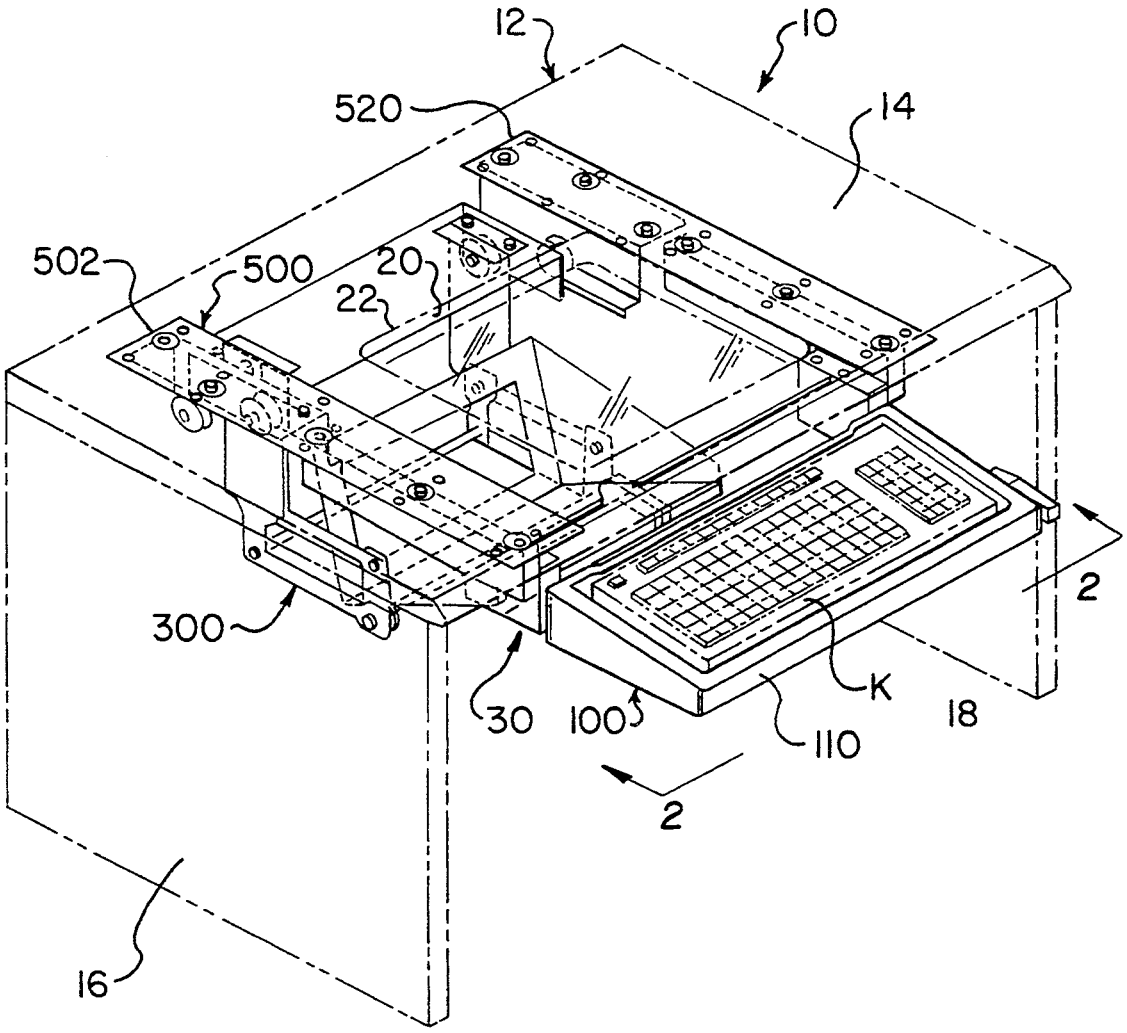
FIG. 1 is a perspective view of an underdesk monitor workstation assembly.

One application of the present invention is illustrated in FIG. 1. Workstation 10 includes a desk-type structure 12 having a working surface 14, and sides 16, 18. Opening 20 is formed in the front center portion of working surface 14. Transparent panel 22 is inlaid into opening 20 flush with working surface 14. Transparent panel 22 can be formed of glass, or transparent plastic, or other suitable materials. Transparent panel 22 is-preferably tinted to have a non-glare surface.

Figure 2:
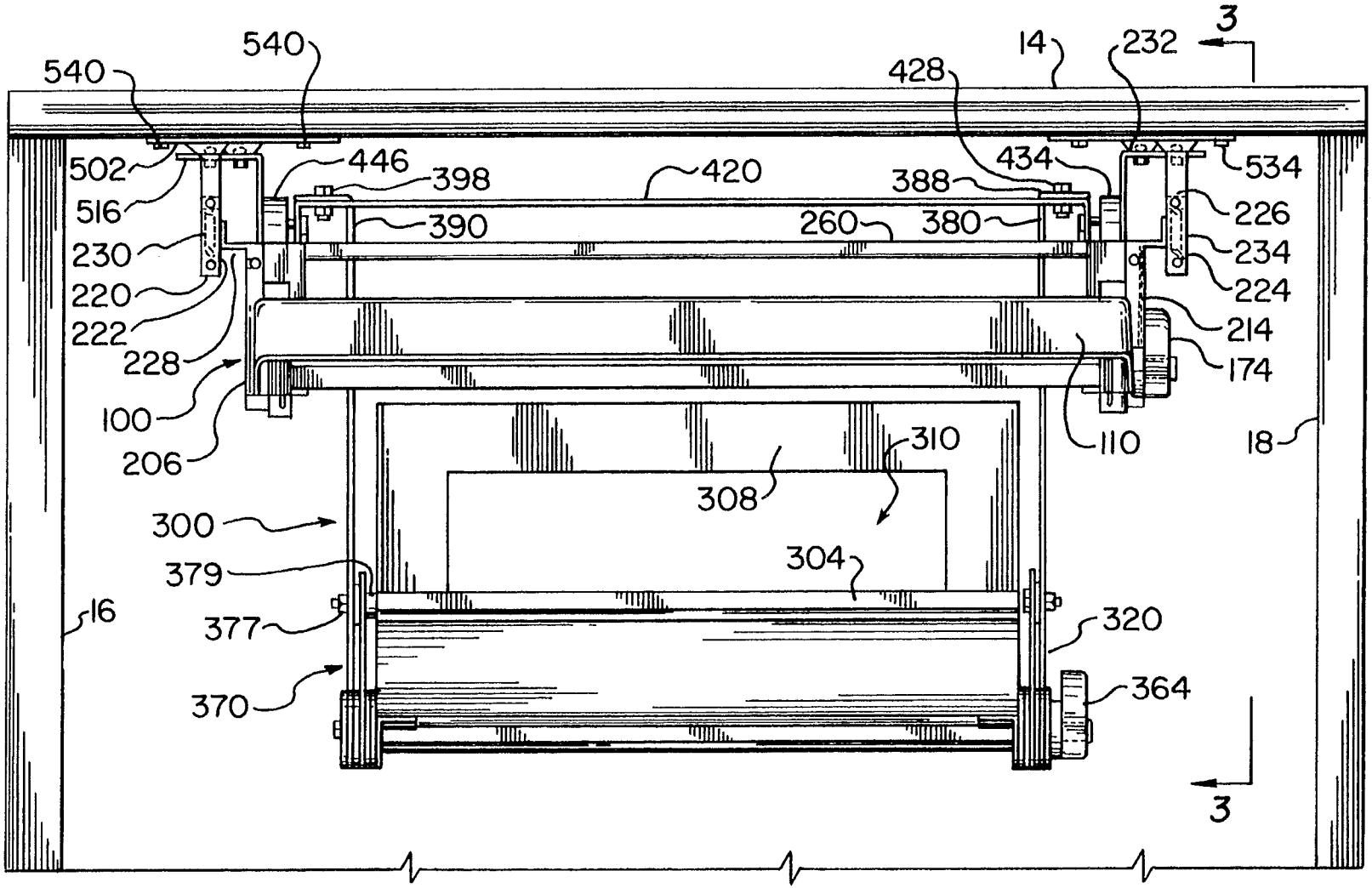
FIG. 2 is a front view of the workstation of FIG. 1.
Figure 3:
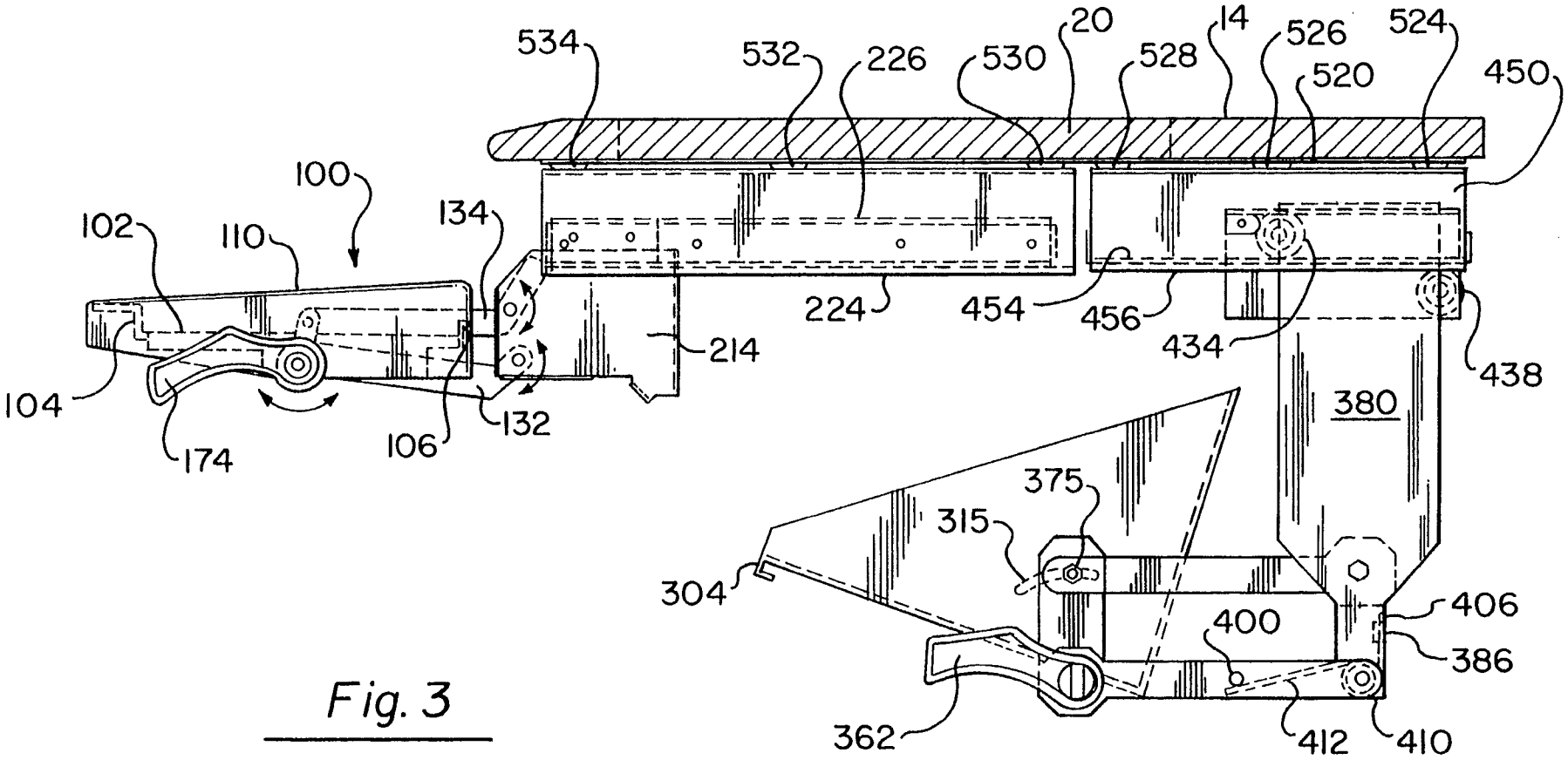
FIG. 3 shows a cross-sectional view of the workstation of FIG. 1.

Workstation assembly 30 is mounted underneath working surface 14 of workstation 10. Workstation assembly 30, in this preferred embodiment, includes keyboard support assembly 100, monitor support assembly 300, and bracket assembly 500. Bracket assembly 500 mounts keyboard support 100 and monitor assembly 300 to the underside of working surface 14. These individual assemblies are illustrated in FIGS. 1–3. Each assembly is discussed in detail below.

Keyboard Assembly 100

Keyboard assembly 100 supports a computer keyboard, such as keyboard "K" illustrated in FIG. 1. Keyboard assembly 100 is movable between a working position, shown in FIG. 1, when the computer is in use, and a retracted position, not shown, underneath working surface 14 when the computer is not in use. The retracted keyboard position allows workstation 10 to function as a desk with the entire working surface 14 available for use. The details of keyboard assembly 100 are illustrated in FIGS. 2–7.

Figure 4:
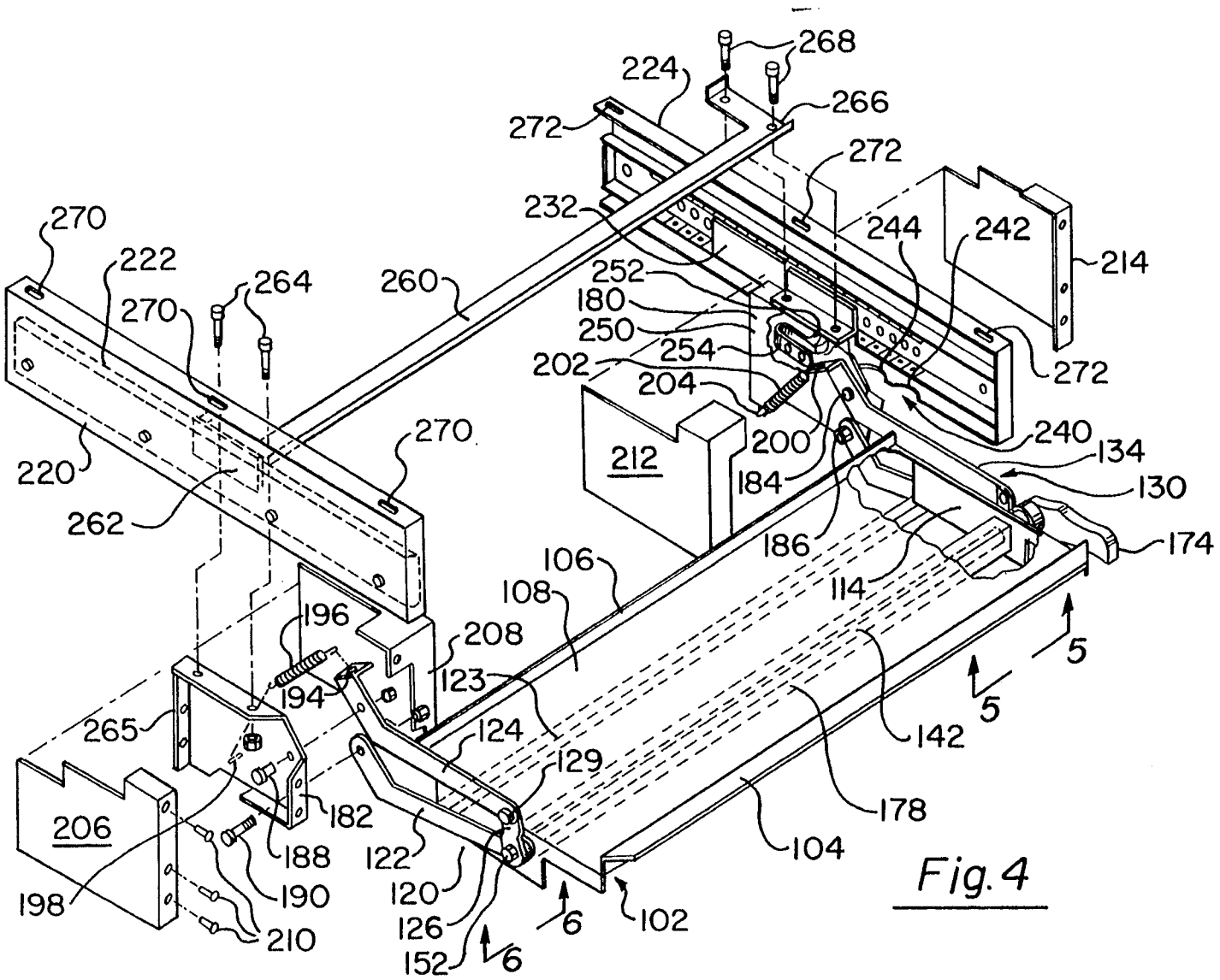
FIG. 4 is a view of the keyboard support assembly of the present invention.

Keyboard assembly 100, as shown in FIG. 4, includes keyboard support member 102. Keyboard support member 102 includes front edge portion 104 which extends up and out from keyboard support member 102. Rear edge portion 106 extends upward from the rear of keyboard support member 102. Center portion 108 of keyboard support member 102 is substantially flat. Keyboard tray 110, shown in FIGS. 1 and 3, is formed of a lightweight, durable plastic and placed onto keyboard support member 102. Front edge portion 104 and rear edge portion 106, shown in FIG. 3, prevent keyboard tray 110 from slipping off keyboard support member 102. Keyboard tray 110 includes a center portion for holding standard sizes of computer keyboards.

Figure 5:
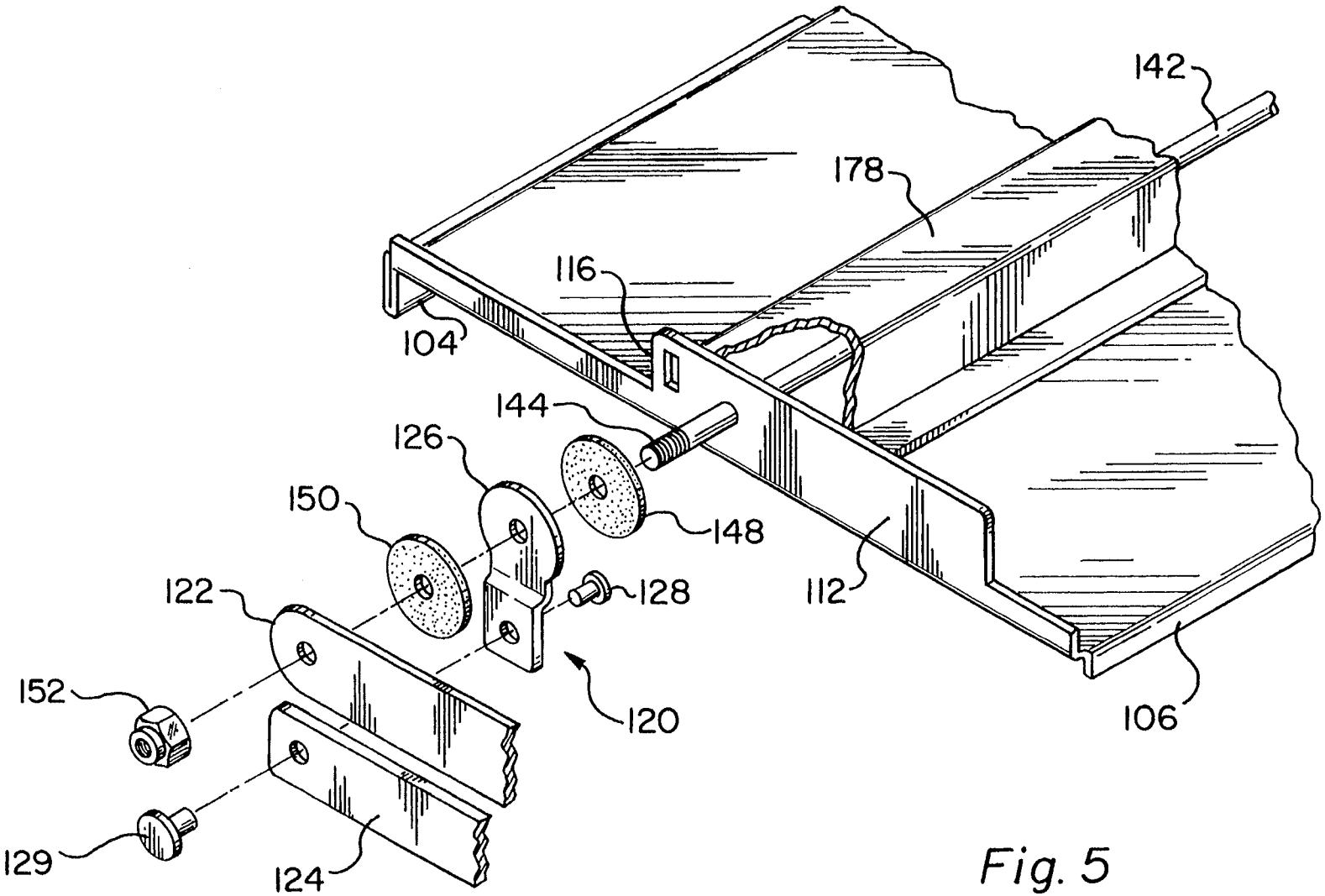
FIG. 5 is an upside down view of the left side of the keyboard support assembly linkage mechanism.
Figure 6:
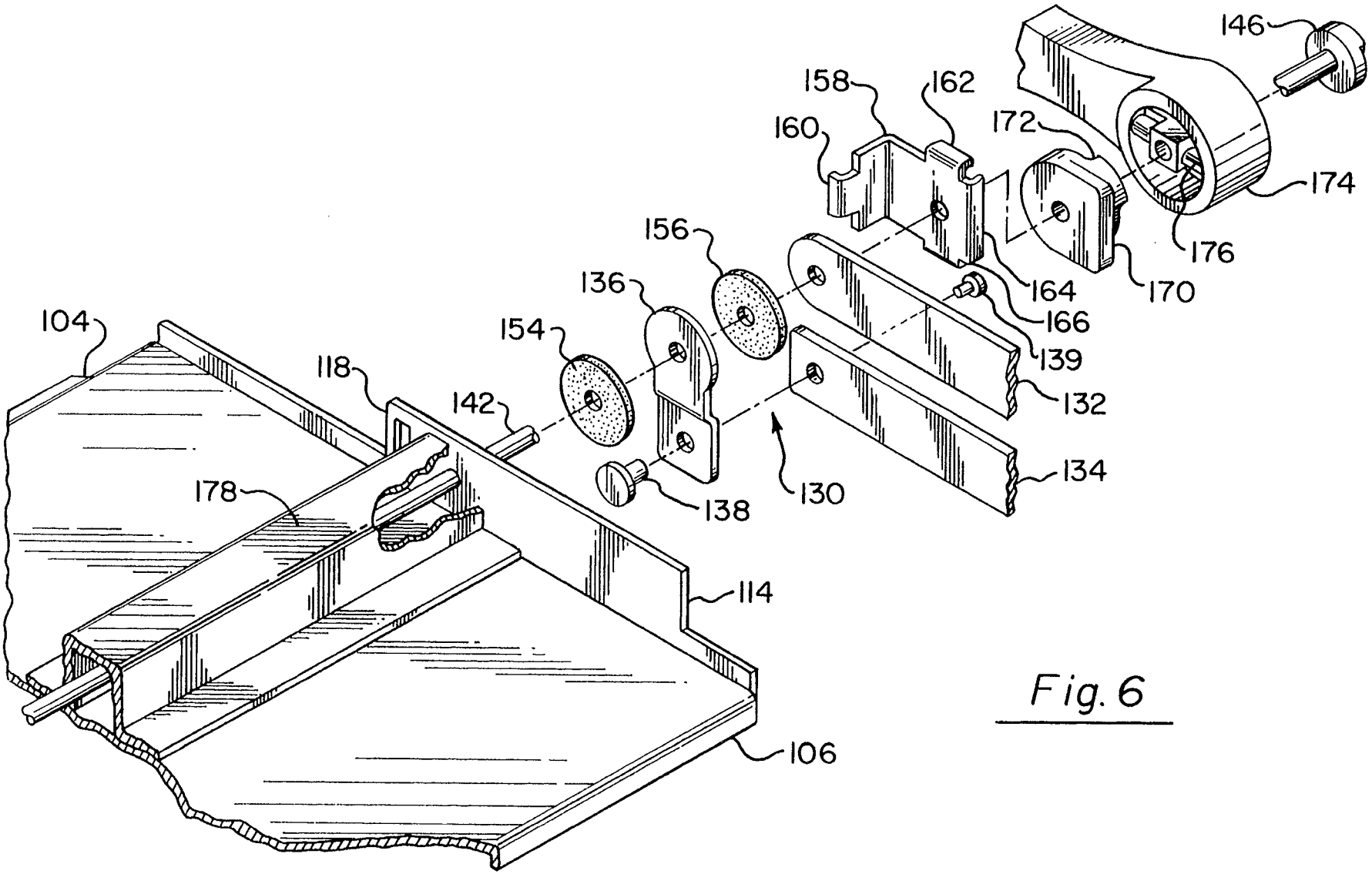
FIG. 6 is an upside down view of the keyboard support assembly right side linkage mechanism.

Keyboard support member 102, as shown in FIGS. 5 and 6, also includes downwardly extending side portions 112, 114. Side portion 112, as shown in FIG. 5, includes slot 116. Side portion 114, as shown in FIG. 6, includes slot 118.

Keyboard support member 102 is supported in keyboard support assembly 100 by linkage mechanisms 120, 130, as shown in FIG. 4. These linkage mechanisms 120, 130 allow keyboard support member 102 to pivot about at least two axes for vertical and angular adjustment. Linkage mechanism 120, shown in FIGS. 4 and 5, includes link arm 122 and link arm 124. Link arm 122 and link arm 124 are pivotally mounted to link arm 126 by fasteners 128, 129 and actuator rod 142. Actuator rod 142 includes threaded end portion 144 and head portion 146 (shown in FIG. 6). Keyboard support member 102 is pivotally mounted, as described below, on actuator rod 142. Actuator rod 142 is discussed in greater detail below. Linkage mechanism 120, shown in FIG. 5, also includes friction washers 148, 150 spaced on each side of link arm 126. The friction washers are formed from brake pad materials or the like. Friction washer 148 is mounted between keyboard support member side 112 and link arm 126. Friction washer 150 is mounted between link arm 126 and link arm 122. Fastener nut 152 secures friction washer 148, link arm 126, friction washer 150 and link arm 122 onto actuator rod 142.

Linkage mechanism 130, shown in FIG. 6, includes link arm 132, link arm 134 and link arm 136. Link arms 134, 136 are pivotally mounted to one another by fasteners 138, 139. Friction washer 154 is mounted on actuator rod 142 between link arm 136 and side portion 114. Friction washer 156 is mounted on actuator rod 142 between link arm 136 and link arm 132. Spring arm 158 is mounted on actuator rod 142 between link arm 132 and cam member 170. Spring arm 158 includes tab portion 160 which engages in slot 118 of keyboard support member 102. Side portions 162, 164, 166 of spring arm 158 engage the sides of cam member 170 to prevent cam member 170 from rotation relative to spring arm 158 and link arm 132. Lever 174 is mounted on actuator rod 142 between cam member 170 and actuator rod head portion 146. Lever 174 is rotatable relative to cam member 170. Cam member 170 includes ramp cam portions 172, shown in FIGS. 7(*a*), 7(*b*), which engage cam portions 176 on the inner portion of lever 174. Rectangular channel 178, shown in FIGS. 5 and 6, extends over actuator rod 142 to cover actuator rod 142 and to provide torsional stiffness to keyboard support member 102. An additional torsion rod 123 is mounted between link arms 122, 132 to provide additional torsional stiffness.

Linkage mechanism 130 is pivotally mounted on carriage support 180 as shown in FIG. 4. Link arm 134 is pivotally attached to carriage support 180 by fastener 184. Link arm 132 is pivotally attached to carriage support 180 by fastener 186. Linkage mechanism 120 is similarly mounted on carriage support 182. Link arm 124 is pivotally attached to carriage support 182 by fastener 188. Link arm 122 is pivotally affixed to carriage support 182 by fasteners 190, 192. Link arm 124 includes an upwardly extending end portion 194 on which spring 196 is attached. The other end of spring 196 is secured to pin 198 mounted on carriage support 182. Spring 202 is attached in a similar fashion between upwardly extending end portion 200 of link arm 134 and pin 204 on carriage support 180. Springs 200, 202 provide an upward bias on keyboard support member 102 to counterbalance the weight of a keyboard on keyboard tray 110. The upwardly extending end portions 194, 200 provide an additional torsional lift to keyboard support member 102 and also maintain the pairs of link arms in a substantially parallel relationship with one another.

Covers 206, 208 are mounted over carriage support 180 by fasteners 210. Covers 212, 214 are mounted over carriage support 182 in a similar manner. Rectangularly-shaped support members 220, 224, shown in FIGS. 2 and 4, include roller guides 222, 226, respectively. Scalloped notches 240 are formed along the lower inside edges of support members 220, 224. Notches 240 include rounded ridges 242 and semi-circular notches 244. Spring roller detent 250 is mounted on carriage support 180 by fasteners 254. Spring roller detent 250 includes a circular roller 252 mounted on spring arm 256 that biases circular roller 252 outwardly for engagement with notches 240. Spring roller detent 250 is shown only on carriage support 180. However, a second spring roller detent (not shown) is affixed to carriage support 182 for engagement with notches (not shown) on support member 220.

Bar ends 262, 266 of torsional support bar 260 are fastened to carriage supports 180, 182 and to carriage members 222, 226 by fasteners 264, 268. These fasteners also attach carriage supports 180, 182 onto carriage members 222, 226. Rollers 230, shown in FIG. 2, are rotatably mounted on carriage member 228. Rollers 234 are rotatably mounted on carriage member 232. Rollers 230, 234 also rotatably engage in roller guides 222, 226 which are secured to support members 220, 224. Support members 220, 224 are adapted to be secured to bracket assembly 500, as discussed below. Torsional support bar 260 provides stiffening to the carriage assembly to ensure that carriage members 222, 226 will move together as the carriage assembly is moved horizontally. The carriage assembly is thus able to move horizontally by the movement of rollers 230, 234 in roller guides 222, 226.

Operation of Keyboard Assembly 100

Figures 7A, 7B:
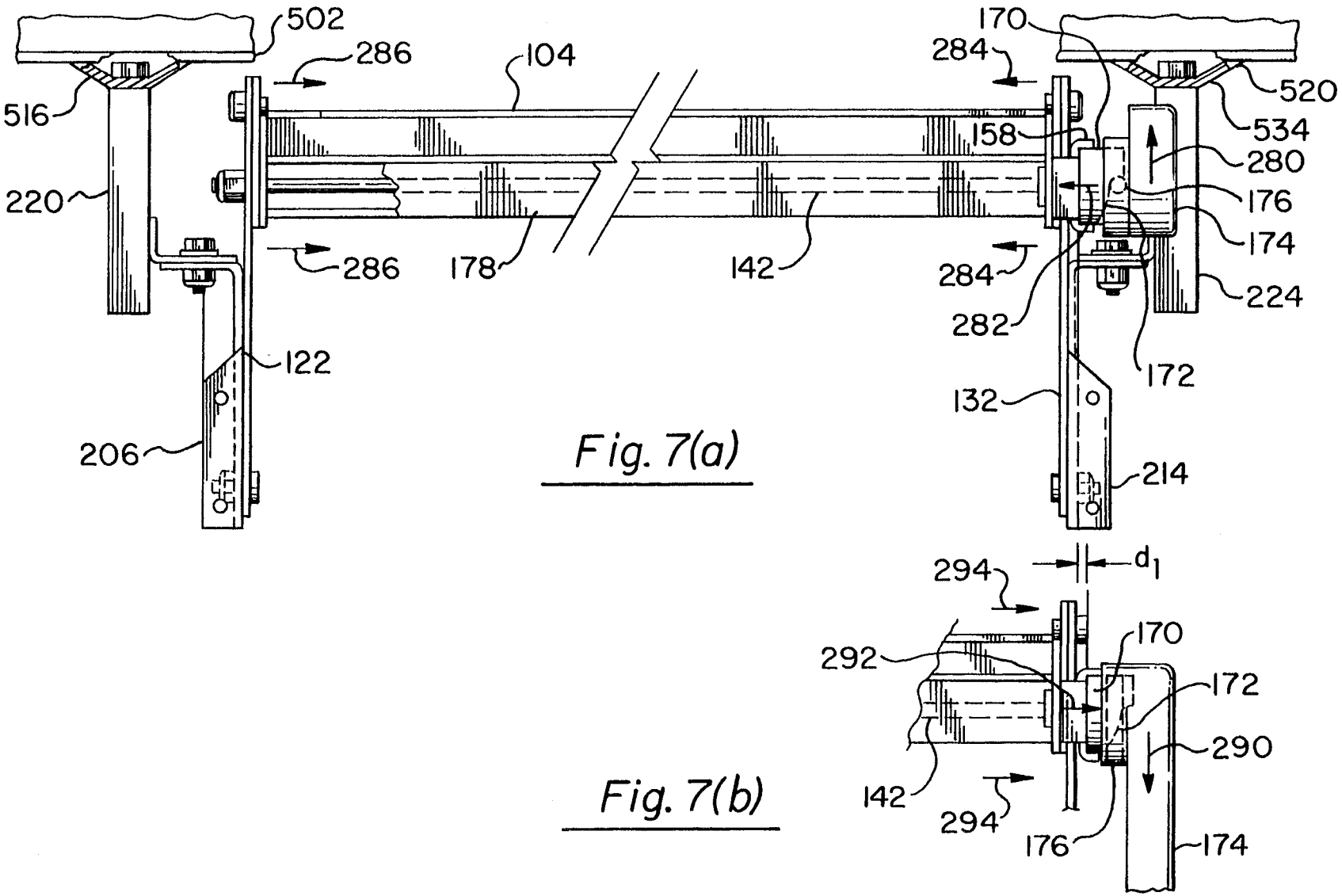
FIG. 7(*a*) is a front view of the keyboard support assembly in the clamped position.

Keyboard support member 102 can be easily adjusted, as illustrated in FIGS. 3, 7(*a*), and 7(*b*). Keyboard support member 102 is moved horizontally relative to workstation 10 by rollers 230, 234 to a desired horizontal position. Once keyboard support member 102 is in the approximate selected horizontal position, spring roller detents 250, shown in FIG. 4, on each side of the carriage assembly will center and lock keyboard support member 102 in position. Rollers 252 will center keyboard support member 102 by rolling into the nearest semi-circular notch 240 on support members 220, 240.

The angular and vertical position of keyboard support member 102 is also easily adjusted as well as securely clamped when in use. Keyboard support member 102 is clamped in position when lever 174 is in the up position, as indicated by arrow 280 in FIG. 7(*a*). In this position, cam surface 176 of lever 174 fully engages cam surface 172 of cam member 170. This applies a force, indicated by arrow 282, against spring arm 158. Spring arm 158 is thus biased against link member 132 to apply pressure, as indicated by arrows 284, 286 on friction washers 156, 154, 150, 148 against the link arms and keyboard support member 102. This pressure is sufficient to clamp keyboard support member 102 in position.

Keyboard support member 102 is easily adjustable when lever 174 is rotated downward, as indicated by arrow 290 in FIG. 7(*b*). In this position, cam surface 176 of lever 174 is moved down ramp cam surface 172 of cam member 170. This allows cam member 170 to move along the axis of actuator rod 142, as indicated by arrow 292, a distance "$d_1$", shown in FIG. 7(*b*). The biasing by spring arm 158 against link arm 132 is lessened to reduce the pressure against the friction washers, as indicated by arrows 294. Keyboard support member 102 is thus able to freely pivot about actuator rod 142 and about fasteners 184, 186, 188, 190, as indicated in FIG. 3.

The spring biasing of keyboard support member 102 ensures that the keyboard will not suddenly drop once the clamping pressure is released. Keyboard support member 102 is adjusted vertically by pivoting the keyboard assembly about fasteners 184, 186, 188, 190. The angular adjustment of keyboard support member 102 is done by pivoting keyboard support member 102 about actuator rod 142.

Once the desired vertical and/or angular position is selected, lever 174 is rotated upward, as shown by arrow 280 in FIG. 7(*a*). This clamps linking mechanisms 120, 130 to lock keyboard support member 102 in position. The entire adjusting operation can be performed by one hand. Lever 174 is rotated, keyboard support member 102 is rotated and either raised or lowered as necessary, and lever 174 is rotated back. The keyboard adjustment mechanism does not interfere with the viewing and operation of an underdesk monitor.

Monitor Support Assembly 300

Figure 8:
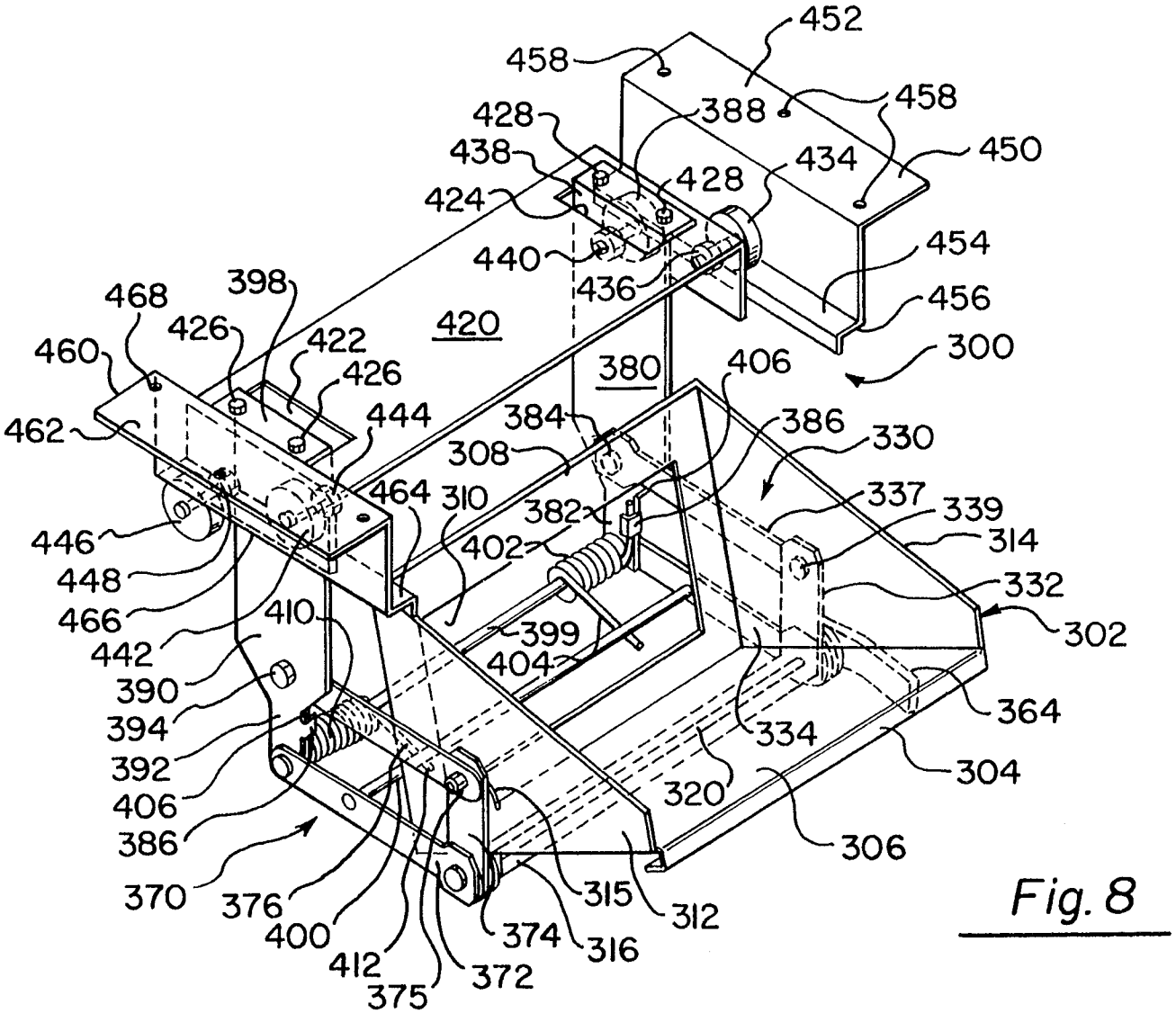
FIG. 8 is a perspective view of the monitor support assembly.

Monitor support assembly 300 is designed to support a computer monitor for viewing through a transparent opening in the workstation. Monitor support assembly 300, as shown in FIG. 8, includes monitor support member 302 for supporting a computer monitor. Monitor support member 302 includes front edge 304, bottom support surface 306 and rear wall 308. Rear wall 308 includes a center cut-out portion 310 for routing of cables and for ventilation of the computer monitor. Triangularly-shaped side walls 312, 314 provide support and rigidity of monitor support member 302. Side wall 312 includes semi-circular slot 315, as shown in FIGS. 3 and 8. Rectangularly-shaped channel member 316 extends across the center of the underside of bottom support surface 306. Channel member 316 includes end walls 318, 319, shown in FIGS. 9, 10.

Figure 9:
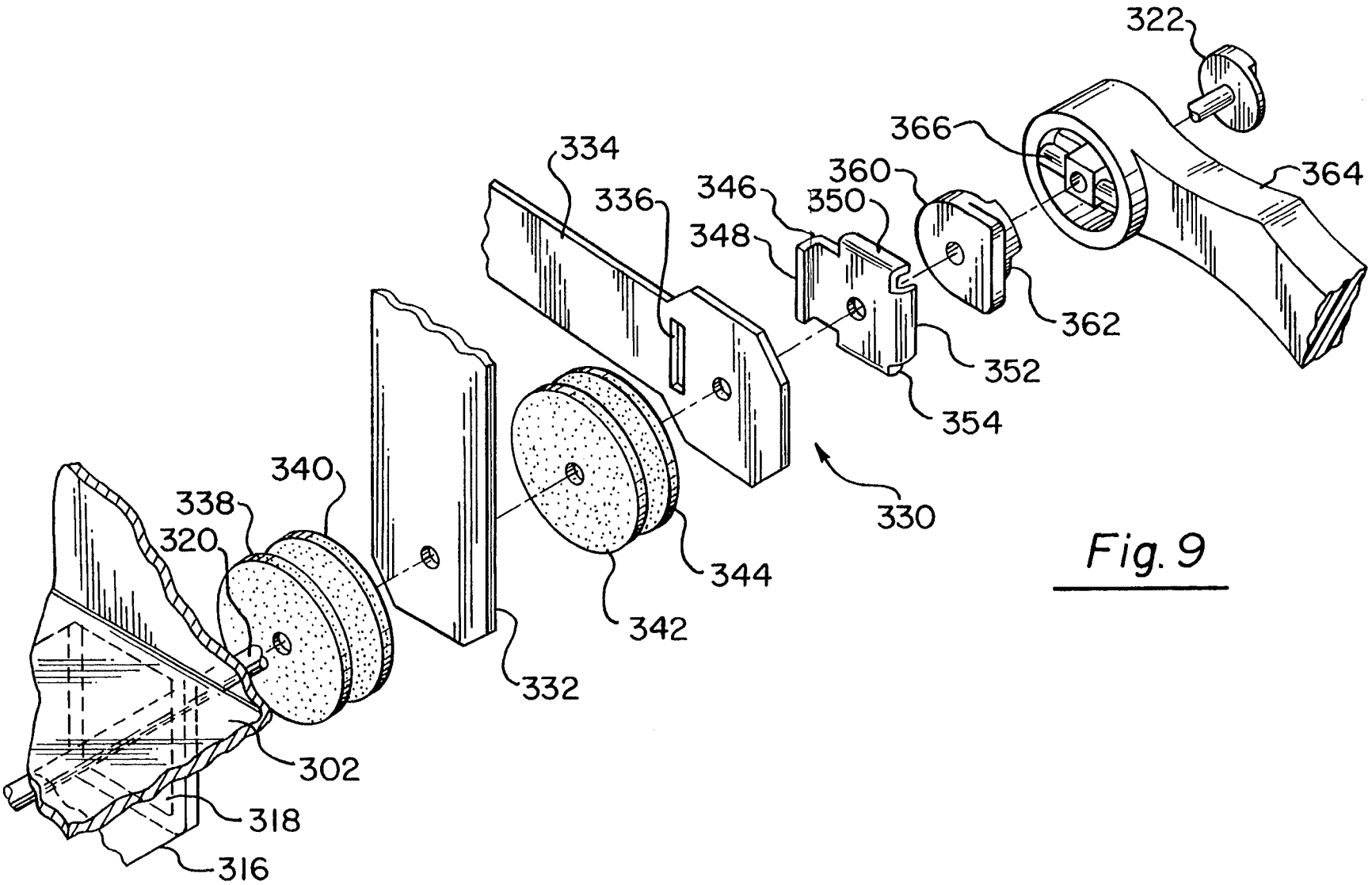
FIG. 9 is an exploded view of the monitor support assembly right side linkage.
Figure 10:
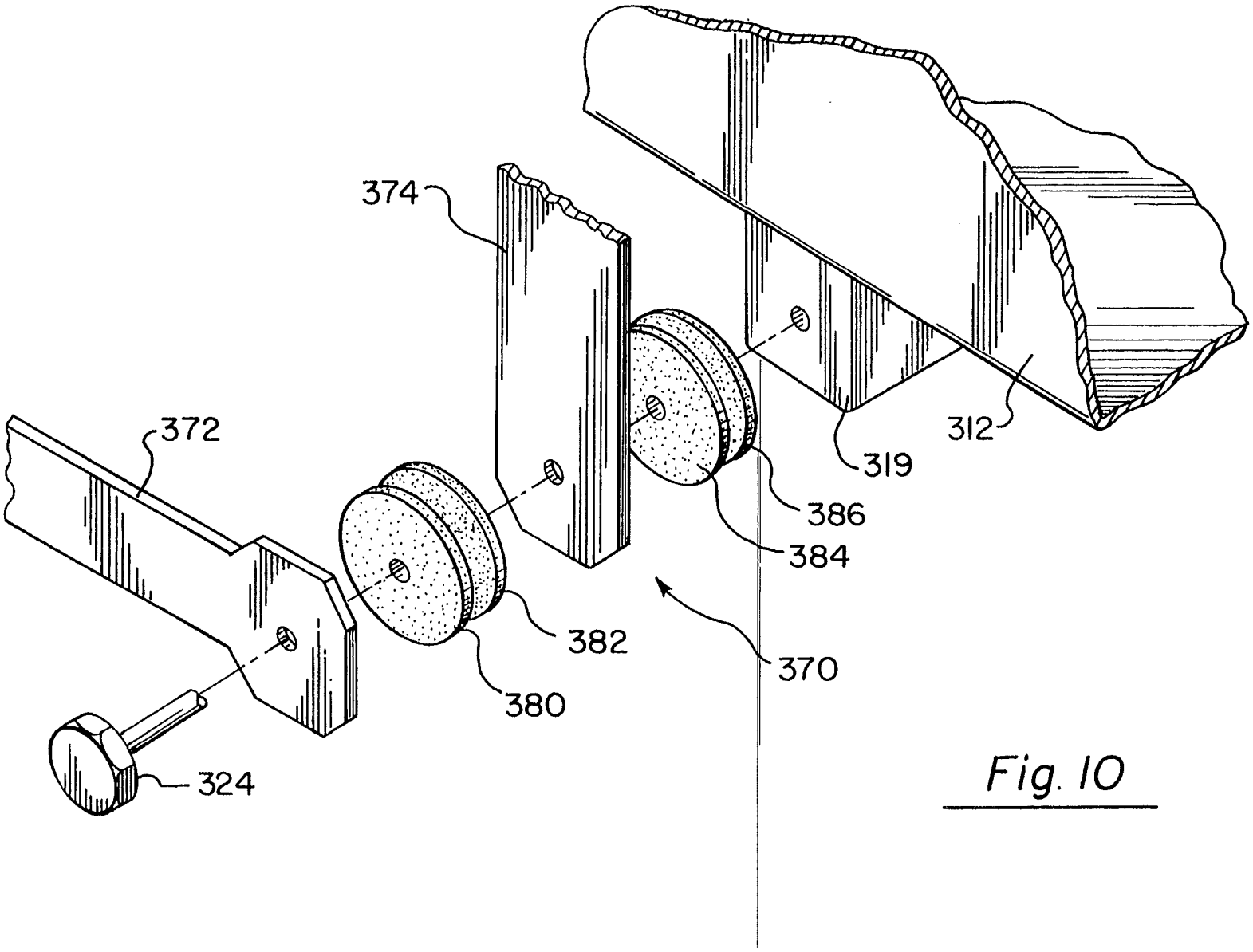
FIG. 10 is an exploded view of the monitor support assembly left side linkage.

Monitor support member 302, shown in FIGS. 8–10, is pivotally mounted on actuator rod 320. Actuator rod 320 is inserted through end walls 318, 319 to extend through channel member 316. Actuator rod 320 includes head portion 322, shown in FIG. 9, and end fastener 324, shown in FIG. 10. Monitor support member 302 is supported on assembly 30 by linkage mechanisms 330, 370.

Linkage mechanism 330, as illustrated in FIG. 8, includes link arms 332, 334, and 337. Link arm 332 and link arm 337 are pivotally connected by fastener 339. Link arms 332, 334 are mounted on actuator rod 320, as shown in FIG. 9. Friction washers 338, 340 are mounted on actuator rod 320 between end wall 318 and link arm 332. Friction washers 342, 344 are mounted on actuator rod 320 between link arm 332 and link arm 334. Spring arm 346 is mounted adjacent link arm 334. Tab portion 348 of spring arm 346 is inserted into slot 336 of link arm 334 to prevent spring arm 346 from rotating relative to link arm 334. Cam member 360 having ramp cam surfaces 362 is mounted on actuator rod 320 adjacent to spring arm 346. Side portions 350, 352, 354 of spring arm 346 engage cam member 360 to prevent cam member 360 from rotating relative to spring arm 346 and link arm 334. Lever 364 is rotatably mounted on actuator rod 320 between cam member 360 and actuator rod head portion 322. Cam surfaces 366 of lever 364 are engagable by cam surfaces of cam member 360. Lever 364 is rotatable relative to cam member 360.

Linkage mechanism 370, as shown in FIG. 8, includes link arm 372, 374, and 376. Link arm 372 and link arm 374, as shown in FIG. 10, are rotatably mounted on fastener 324 of actuator rod 320. Friction washers 380, 382 are mounted between link arm 372 and link arm 374. Friction washers 384, 386 are mounted between link arm 374 and end wall 319. Link arm 376 and link arm 374 are pivotally connected by fastener pin 375 as shown in FIG. 8. Fastener pin 375 engages in semi-circular slot 315 in side wall 312 as shown in FIG. 3.

Linkage mechanisms 330, 370, as shown in FIG. 8, are pivotally mounted on support members 380, 390, respectively. Support member 380 includes lower neck portion 382 having clip portion 386. Upper end portion 386 extends perpendicularly from support member 380. Link arm 337 is pivotally connected to support member 380 by fastener 384. Link arm 334 is pivotally connected to support member 380 by rod 399, as discussed below.

Support member 390 is identical to support member 380. Support member 390 includes lower neck portion 392, clip portion 396, and upper portion 398. Link arm 376 is pivotally connected to support member 390 by fastener 394. Link arm 372 is pivotally connected to support arm 390 by rod 399. Torsion rod 400 is connected to link arms 334, 372 to provide torsional rigidity to the monitor support assembly. Torsion springs 402, 410 are mounted on rod 399 to bias monitor support 302 upward against the weight of the computer monitor. Arm 404 of torsion spring 402 engages torsion rod 400 to bias monitor support upward. Arm 406 is retained by clip portion 386 to provide the necessary opposing force for torsion spring 402. Likewise, arm 412 of torsion spring 410 engages torsion rod 400 while arm 414 is retained in clip portion 396.

Upper end portions 388, 398 of support members 380, 390 are mounted through slots 422, 424, respectively, as shown in FIGS. 2 and 8, of carriage support 420 by fasteners 426, 428. Roller 434 is rotatably mounted on carriage support 420 by fastener 436. Roller 438 is rotatably mounted on carriage support 420 by fastener 440 to be vertically and horizontally offset from roller 434. Roller 442 is rotatably mounted on the other end of carriage support 420 by fastener 444 to rotate along the same longitudinal axis as roller 434. Roller 446 is rotatably mounted on the same end of carriage support 420 by fastener 448 to be vertically and horizontally offset from roller 442. Roller 446 rotates in the same longitudinal axis as roller 438.

Bracket members 450, 460 provide tracks for rollers 434, 438, 442, 446 to move monitor support assembly 300 horizontally. Bracket members 450, 460 also secure monitor support assembly to bracket assembly 500, as discussed below. Bracket member 450 also includes upper mounting surface 452 having holes 458 for fasteners. The lower portion of bracket member includes upper track 454 and lower track 456. Bracket member 460 is similar, having upper mounting surface 462, fastener holes 468, upper track 464, and lower track 466. The vertical offset of rollers 434, 442 from rollers 438, 446 is sufficient so that the rolling contact surfaces of rollers 434, 442 is spaced by the thickness of lower portion of bracket members 450, 460 from the rolling contact surfaces of rollers 438, 446. The vertical and horizontal offset of front rollers 434, 442 and rear rollers 438, 446 prevents monitor support assembly 300 from tilting forward under the weight of the computer monitor.

Operation of Monitor Support Assembly 300

Monitor support assembly 300 is easily adjustable horizontally, vertically, and angularly. This enables the computer monitor screen to be comfortably viewable through transparent panel 22 on working surface 14 of workstation 10. The horizontal adjustment of monitor support member 302 is accomplished by simply pulling or pushing monitor support member 302. Rollers 434, 438, 442, 446 will easily roll along their respective tracks.

Figures 11A, 11B:
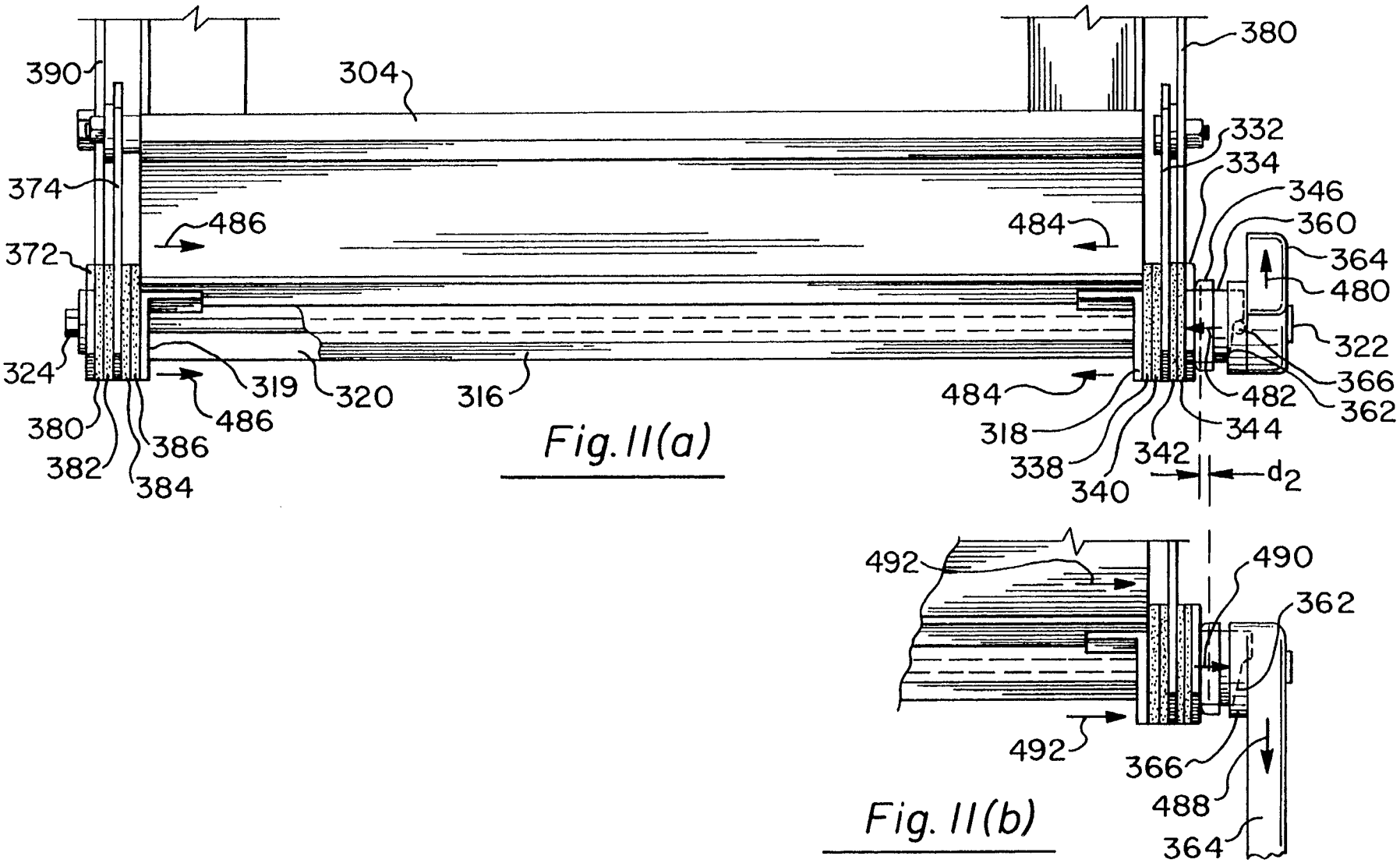
FIG. 11(*a*) is a front view of the monitor support assembly in a clamped position.

The vertical and angular adjustment of monitor support member 302 is similar to the adjustment of keyboard support member 102, discussed above. Monitor support member 302, as shown in FIG. 11(*a*) is initially in a clamped position. In this position, lever 364 is in an up position, as indicated by arrow 480. Cam surface 366 of lever 364 fully engages cam surface 362 of cam member 360. This creates a force, indicated by arrow 482, applied against spring arm 346. Spring arm 346 under this force applies a biasing pressure, indicated by arrows 484, 486, between the friction washers and the link arms and monitor support member end walls. This clamping pressure locks monitor support member 302 in position.

When a vertical and/or angular adjustment is necessary, lever 364 is rotated downward, as indicated by arrow 488 in FIG. 11(*b*). Cam surface 366 is rotated down the ramp of cam surface 362 of cam member 360. This allows cam member 360 to move longitudinally along actuator rod 320 a distance "$d_2$". This releases the force against spring arm 346, as indicated by arrow 490. This in turn releases the biasing pressure, as indicated by arrows 492, on the friction washers, link arms and monitor support member end walls. Monitor support member 302 can then freely pivot about actuator rod 320, rod 399, and fasteners 384, 394.

The vertical adjustment is performed by pivoting monitor support member 302 about rod 399 and fasteners 384, 394. Torsion springs 402, 410 prevent monitor support member 302 from dropping under the weight of the computer monitor. This enables monitor support member 302 to be easily adjustable by one hand.

The angular adjustment is performed by rotating monitor support member 302 about actuator rod 320. Pin 375 in slot 315 of end wall 312, as shown in FIG. 3, prevents monitor support member 302 from tilting too far forward or backward, which might result in the computer monitor falling off monitor support member 302.

Once the desired position of the computer monitor is selected, lever 364 is rotated up, in the position shown in FIG. 11(*a*) to lock monitor support member 302 in position. The vertical and/or angular adjustment of monitor support member 302 can thus be easily performed.

Bracket Assembly 500

Figure 12A:
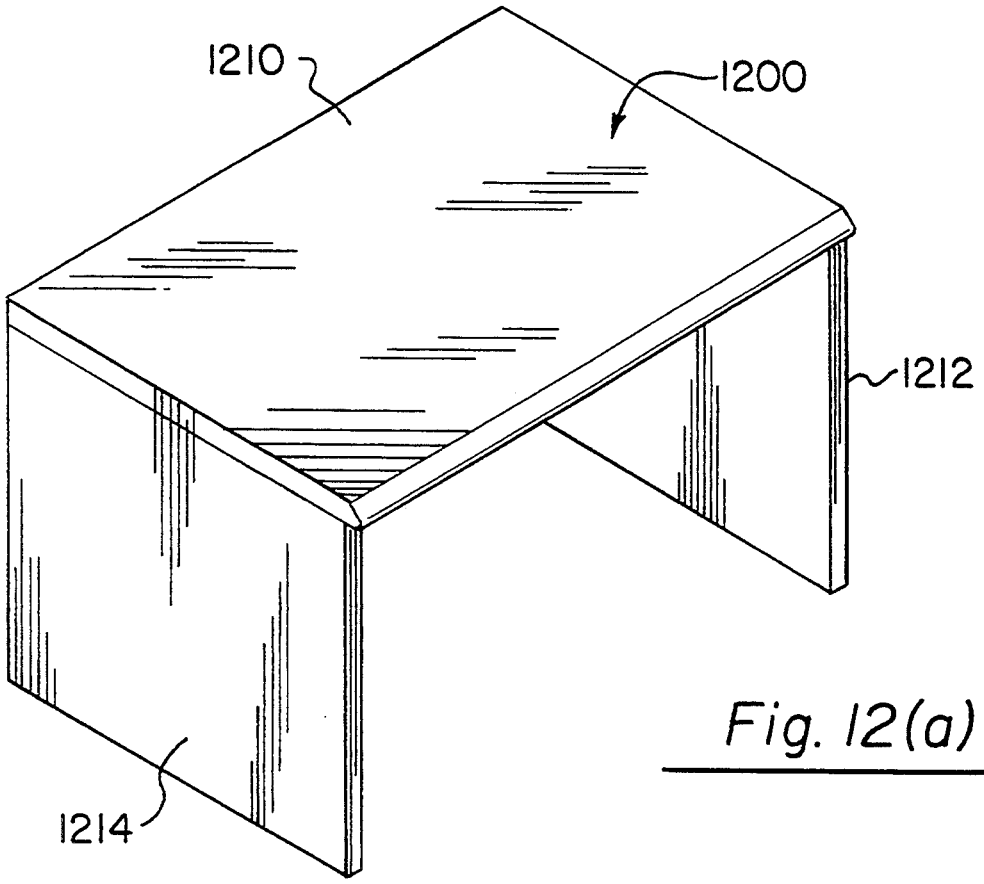
FIG. 12(*a*) is a perspective view of a desk.
Figure 12B:
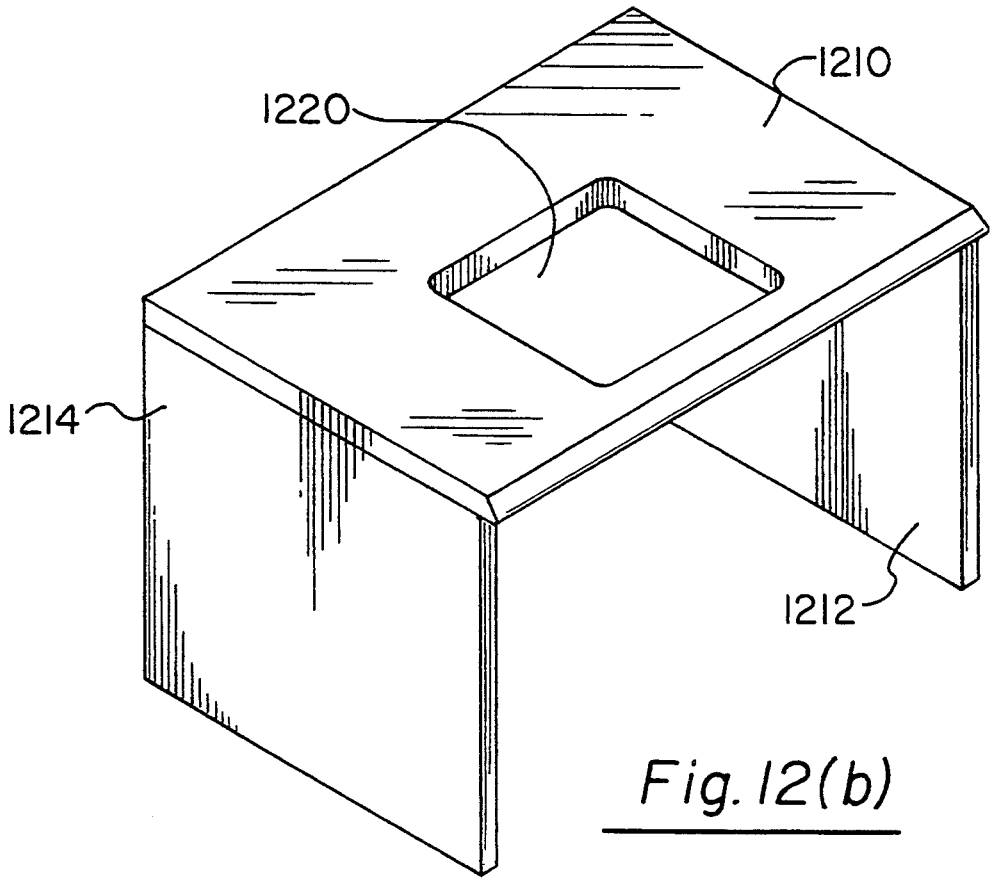
Figure 12C:
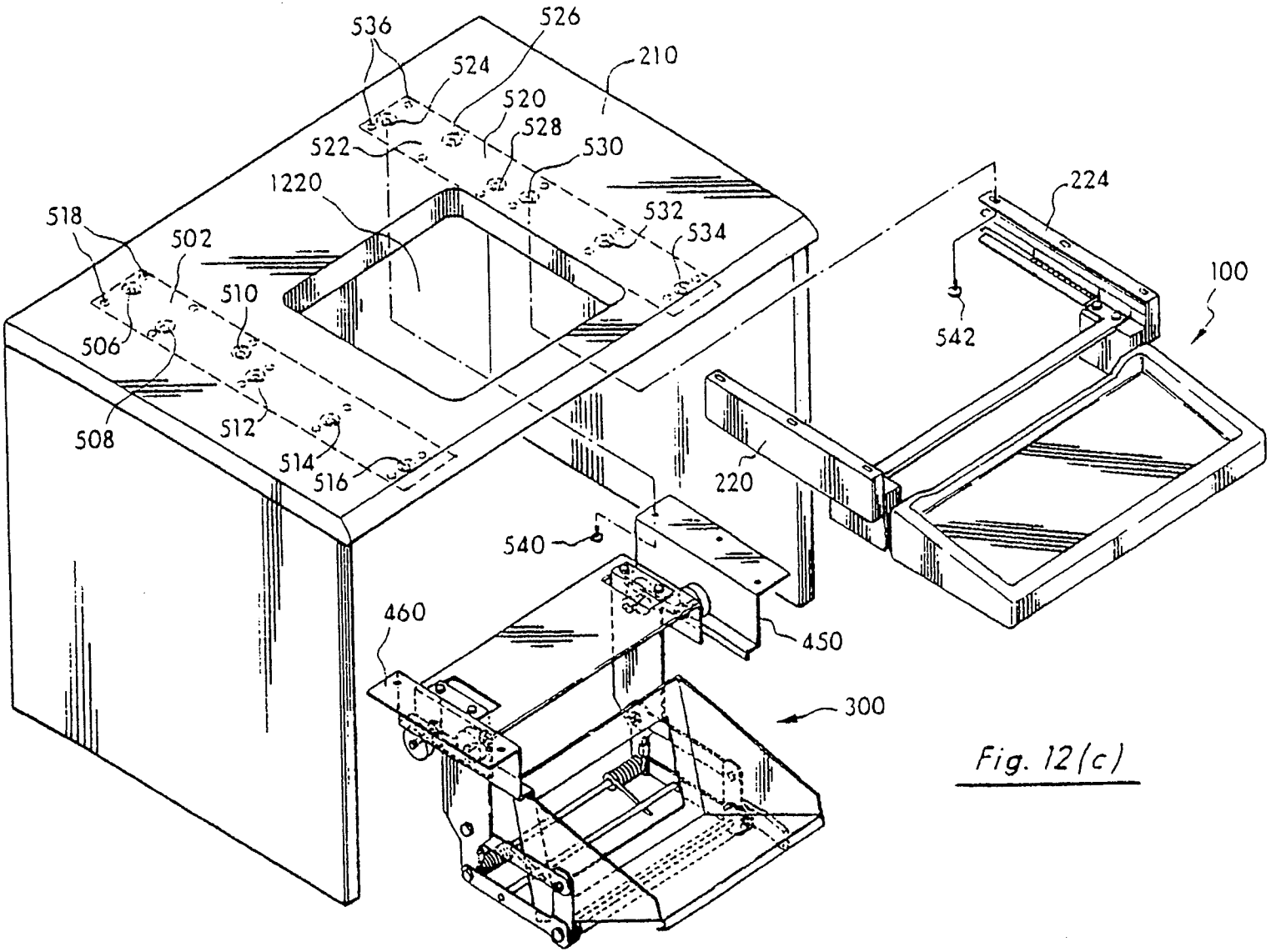
Figure 12:
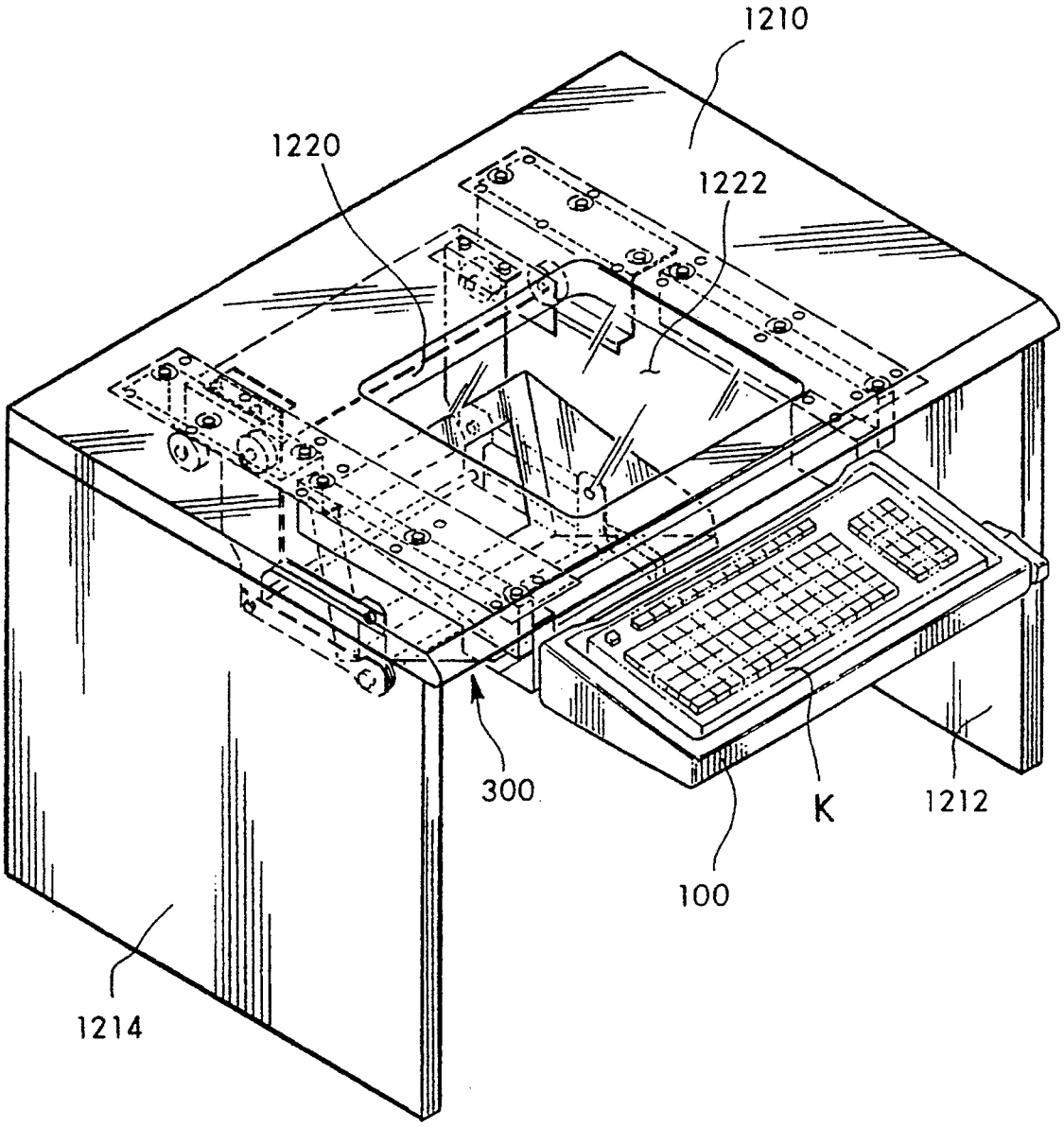

Keyboard support assembly 100 and monitor support assembly 300 can be easily mounted onto a workstation by bracket assembly 500. Bracket assembly 500 includes two elongated bracket members 502, 520, shown in FIGS. 1, 2 and 12(*c*). Bracket member 502, as shown in FIG. 12(*c*), includes planar mounting surface 504. A plurality of indentations, 506–516 are formed in bracket member 502. Each of these indentations includes a center hole. Fastener holes 518 are formed in bracket member 502 spaced outside indentations 506–516. Bracket member 520 is similarly formed with planar mounting surface 522. Indentations 524–534 having center holes are formed in bracket member 520. Fastener holes 536 are formed in bracket member 520 spaced outside indentations 524–534.

Indentations 506–510 of bracket member 502 are positioned to align with fastener holes 468 of bracket member 460 of monitor support assembly 300. Likewise, indentations of 524–528 of bracket member 520 are positioned to align with fastener holes 458 of bracket member 450. Indentations 512–516 and indentations 530–534 are also positioned to align with fastener holes 270, 272 of keyboard support assembly 100. The depth of indentations 506–516 and indentations 524–534 is sufficient so that the fasteners used to secure keyboard support assembly 100 and monitor support assembly 300 to bracket members 502, 520 will not protrude through planar mounting surfaces 504, 522. This enables bracket members 502, 520 to be flush-mounted on the underside of a workstation.

Method of Installation

Workstation assembly 30 is designed to be installed on a workstation at the factory or to convert an existing workstation. The installation in either case is similar. However, in the factory installation, the viewing opening will be pre-cut. An example of conversion workstation assembly 30 onto an existing workstation is illustrated in FIGS. 12(*a*)–12(*d*).

An existing desk-type workstation 1200 is illustrated in FIG. 12(*a*) having working surface 1210, and side walls 1214, 1216. Opening 1220, shown in FIG. 12(*b*), is cut into working surface 1210 according to a template (not shown). The edges of opening 1220 can be beveled to hold a transparent panel, or a bracket can be attached to hold the transparent panel.

Keyboard support assembly 100, as shown in FIG. 12(*c*), is attached to bracket members 502, 520 by fasteners 542 inserted through indentations 512–516 and indentations 530–534. Monitor support assembly 300 is attached to bracket members 502, 520 by fasteners 540 inserted through indentations 506–510 and indentations 524–528. Bracket members 502, 520 are then secured to the underside of working surface 1210 by fasteners, such as screws, through holes 518 and 536.

Transparent panel 1222, as shown in FIG. 12(*d*), is placed into opening 1220 to be flush with working surface 1210. Monitor support assembly 300 can be adjusted, as discussed above, so the computer monitor screen is comfortably viewable through transparent panel 1222. Keyboard support assembly 100 can be adjusted, as discussed above, to a comfortable working position. When the computer is not in use, keyboard support member 100 is pushed into the retracted position beneath working surface 1210. This allows the workstation to be used as a desk.

Figure 13:
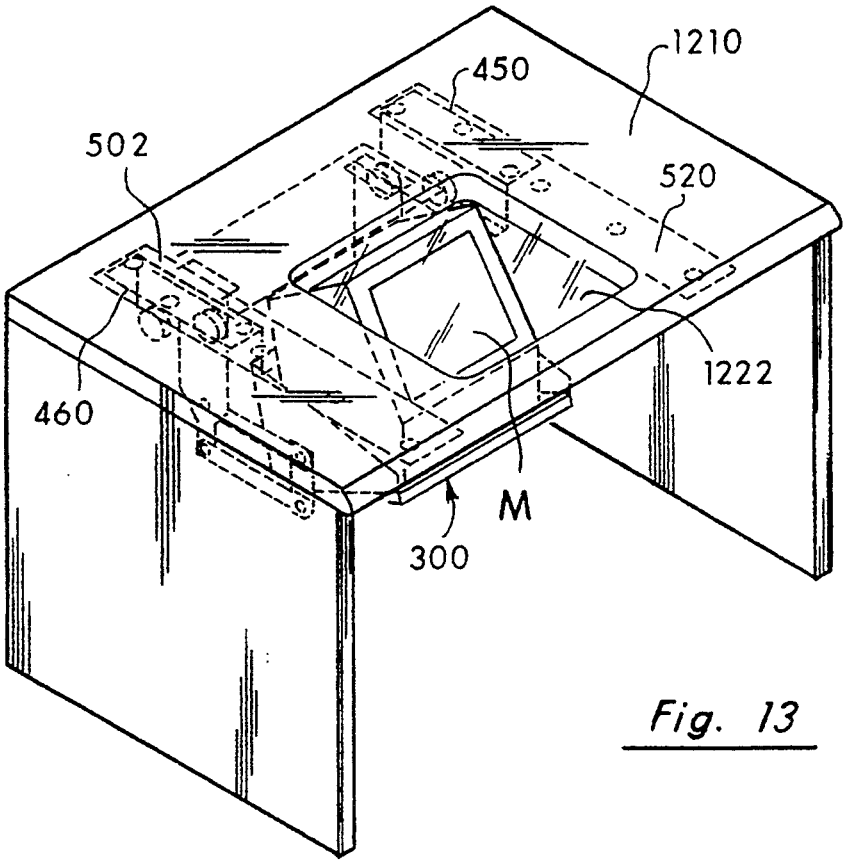
FIG. 13 is a perspective view of only the monitor support assembly mounted onto a workstation.
Figure 14:
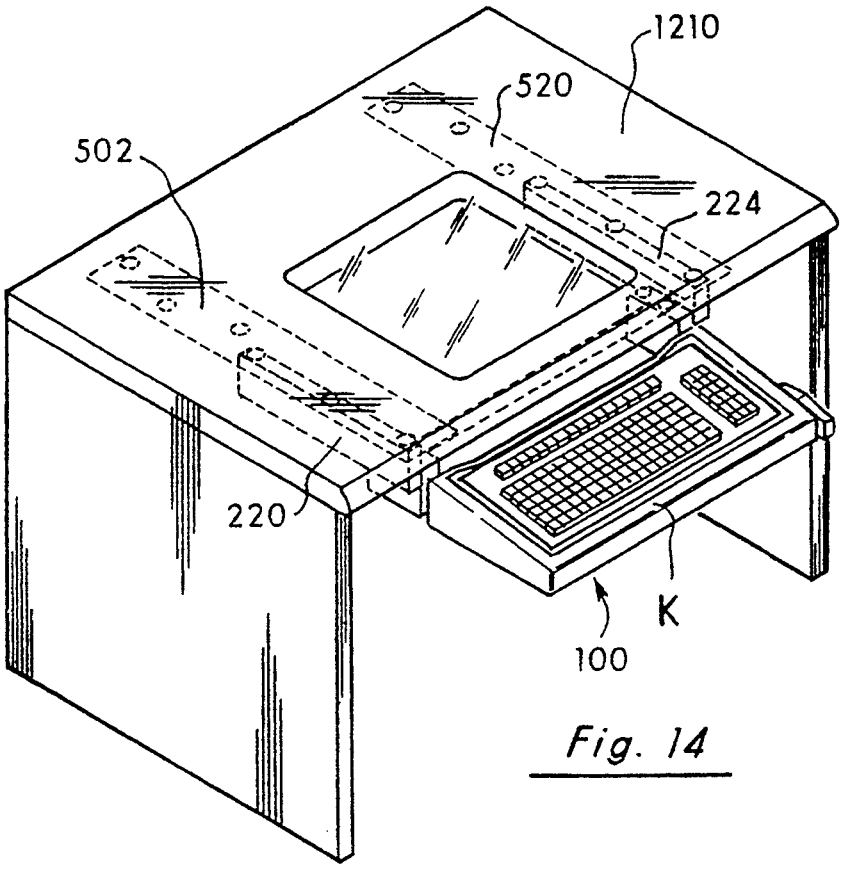
FIG. 14 is a perspective view of only the keyboard support assembly mounted onto a workstation.

Workstation assembly 30 can also be used in various embodiments. For instance, as shown in FIG. 13, bracket members 502, 520 can be used to mount only monitor support assembly 300. Another variation, shown in FIG. 14, includes using bracket members 502, 520 to mount only keyboard support assembly 100. The use of bracket members 502, 520 allows a workstation to be tailored to the specifications of a user.

Figure 15:
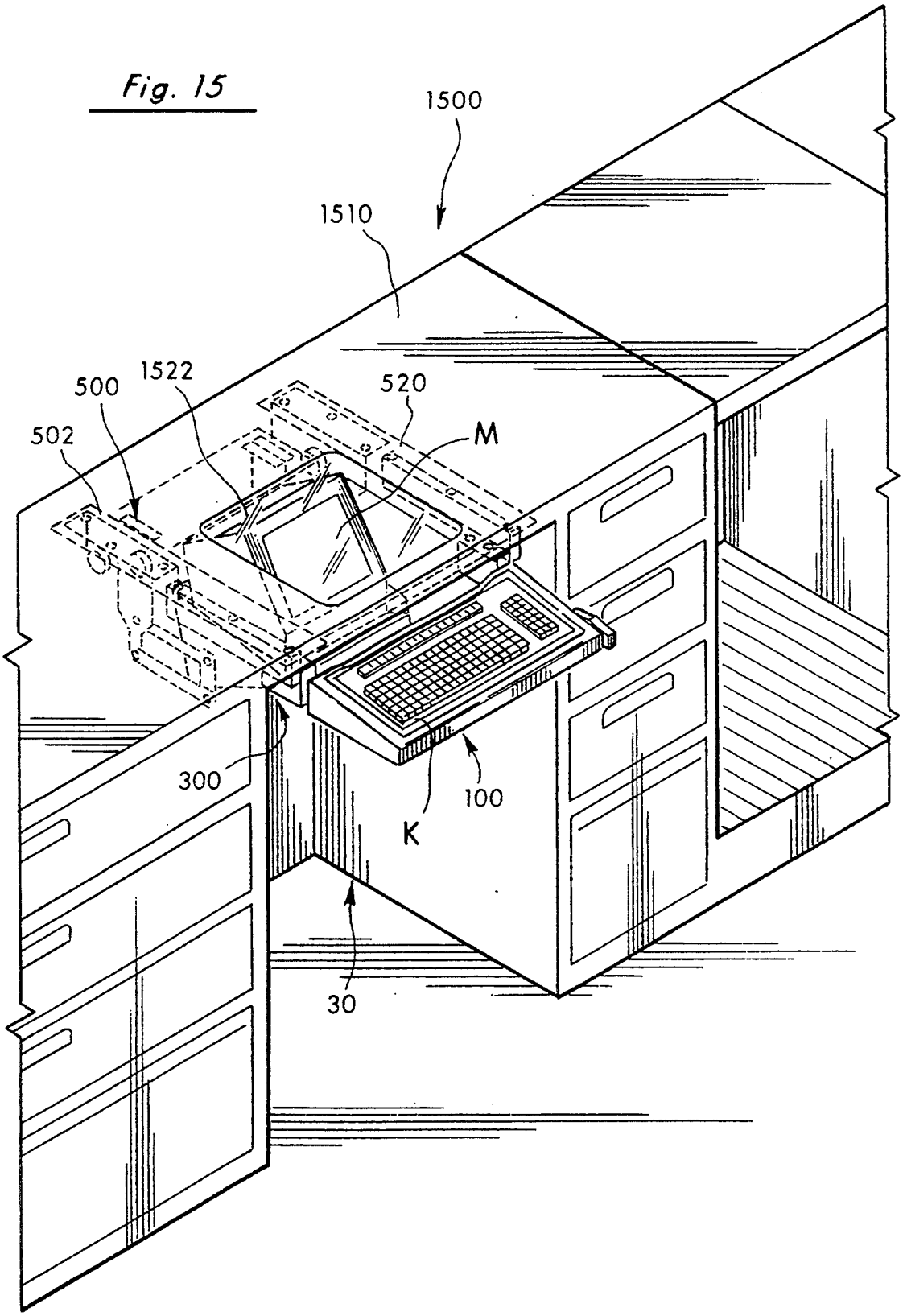
FIG. 15 is a perspective view of a counter workstation using the workstation assembly of the present invention.

Another embodiment of the present invention is illustrated in FIG. 15. Workstation assembly 30 is installed in a counter 1500, such as an airline ticket counter, department store check-out, inventory control and the like. This installation allows the user to stand to operate the computer. Workstation assembly 30 includes keyboard support assembly 100 and monitor support assembly mounted on brackets 502, 520, as discussed above. Bracket members 502, 520 are fastened on the underside of counter working surface 1510. Monitor "M" is viewable through transparent panel 1522. Keyboard "K" is movable from a retracted position to a working position as necessary.

Other embodiments and variations of the present invention are considered to be within the scope of the inventive concept. For instance, a "pop-up" type workstation can be installed in a similar fashion. A "pop-up" workstation allows the monitor to move through an opening of the working surface of the workstation to be viewable. Other variations include installing the monitor support assembly and/or keyboard support assembly in other locations than flush on the underside of the working surface.

We claim:

1. A workstation assembly for an underdesk monitor workstation, said assembly comprising:

an underdesk support assembly;

a monitor support member on said underdesk support assembly for supporting a monitor;

means for infinitely and randomly adjustably positioning said monitor support member vertically and angularly;

means for locking said monitor support member in a selected vertical and angular position relative to the workstation;

means for affixing said underdesk monitor support assembly to a workstation;

a keyboard support assembly for supporting a keyboard;

means for adjustably positioning said keyboard support assembly without interfering with the viewing and operation of a monitor on said underdesk monitor support assembly; and means for affixing said keyboard support assembly to a workstation.

2. The workstation assembly of claim 1 wherein said underdesk monitor assembly further includes:

means for adjustably positioning said monitor support member horizontally.

3. A workstation assembly for an underdesk monitor workstation, said assembly comprising:

a support member for supporting a monitor;

first linkage mechanism;

means for pivotally mounting said first linkage mechanism to a first side of said monitor support member;

a first at least one friction washer mounted between said first linkage mechanism and said first side of said monitor support member;

a second linkage mechanism;

means for pivotally mounting said second linkage mechanism to a second side of said monitor support member;

a second at least one friction washer mounted between said second linkage mechanism and said second side of said monitor support member;

a spring arm biasing said first at least one friction washer and said second at least one friction washer into engagement with said first side and said second side of said monitor support member; and a single actuator member movable between a first position to allow adjustment of said monitor support member and a second position to lock said monitor support member in a selected position;

means for affixing said monitor support member to a workstation;

a keyboard support assembly for supporting a keyboard;

means for adjustably positioning said keyboard support assembly without interfering with the viewing and operation of a monitor supported on said underdesk monitor support assembly; and means for affixing said keyboard support assembly to a workstation.

4. The workstation assembly of claim 3 wherein said single actuator member includes:

cam members which disengage said first at least one friction washer and said second at least one friction washer from engagement with said monitor support member as said single actuator member is moved to said first position.

5. A workstation assembly for an underdesk monitor workstation, said assembly comprising:

an underdesk support assembly for supporting a monitor;

means for adjustably positioning said underdesk monitor support assembly;

means for affixing said underdesk monitor support assembly to a workstation;

a keyboard support member for supporting a keyboard;

means for affixing said keyboard support member to a workstation;

means for adjustably positioning said keyboard support member without interfering with the viewing and operation of a monitor supported on said underdesk monitor support assembly;

said means for adjustably positioning said keyboard member includes a first linkage mechanism;

means for pivotally mounting said first linkage mechanism to a first side of said keyboard support member;

a first at least one friction washer mounted between said first linkage mechanism and said first side of said keyboard support member;

a second linkage mechanism;

means for pivotally mounting said second linkage mechanism to a second side of said keyboard support member;

a second at least one friction washer mounted between said second linkage mechanism and said second side of said keyboard support member;

a spring arm biasing said first at least one friction washer and said second at least one friction washer into engagement with said first side and said second side of said keyboard support member; and a single actuator member movable between a first position to allow adjustment of said keyboard support member and a second position to lock said keyboard support member in a selected position.

6. The workstation assembly of claim 5 wherein said single actuator member includes:

cam members which disengage said first at least one friction washer and said second at least one friction washer from engagement with said keyboard support member as said single actuator member is moved to said first position.

7. A workstation assembly for an underdesk monitor workstation, said assembly comprising:

an underdesk support assembly for supporting a monitor;

means for adjustably positioning said underdesk monitor support assembly;

means for affixing said underdesk monitor support assembly to a workstation;

a keyboard support assembly for supporting a keyboard;

means for affixing said keyboard support assembly to a workstation;

means for adjustably positioning said keyboard support assembly without interfering with the viewing and operation of a monitor supported on said underdesk monitor support assembly;

said means for adjustably positioning said keyboard support assembly includes means for horizontally positioning said keyboard support assembly;

a plurality of horizontally-spaced indentations on said keyboard support assembly; and at least one spring-biased roller wheel affixed to said means for horizontally positioning said keyboard support assembly for engagement with one of said plurality of spaced indentations.

8. A workstation assembly for an underdesk monitor workstation, said assembly comprising:

an underdesk support assembly for supporting a monitor;

means for adjustably positioning said underdesk monitor support assembly;

a first bracket member;

a second bracket member;

means for fastening said underdesk monitor support assembly to said first bracket member and to said second bracket member;

a keyboard support assembly for supporting a keyboard;

means for fastening said keyboard support assembly to said first bracket member and to said second bracket member;

means for fastening said first bracket member to the workstation; and means for fastening said second bracket member to the workstation; and means for adjustably positioning said keyboard support assembly without interfering with the viewing and operation of a monitor supported on said underdesk monitor support assembly.

9. The workstation assembly of claim 8 wherein said means for fastening said first bracket member and said second bracket member to the workstation further includes:

means for fastening said first bracket member to the underside of a working surface of the workstation; and means for fastening said second bracket member to the underside of a working surface of the workstation.

10. A workstation assembly for an underdesk monitor workstation, said assembly comprising:

an underdesk support assembly for supporting a monitor;

a keyboard support assembly for supporting a keyboard;

a first elongated bracket member;

a substantially planar mounting surface on said first bracket member;

a set of horizontally-spaced indentations in said first bracket member;

a hole formed in the center of each of said indentations of said first bracket member;

a first set of holes formed in said first bracket member outside said indentations of said first bracket member;

a second elongated bracket member;

a substantially planar mounting surface on said second bracket member;

a set of horizontally-spaced indentations in said second bracket member;

a hole formed in the center of each of said indentations of said second bracket member;

a second set of holes formed in said second bracket member outside said indentations of said second bracket member;

means for fastening said monitor support assembly and said keyboard support assembly to said first bracket member and to said second bracket member through said holes in said indentations so as to not protrude through said first substantially planar mounting surface and said second substantially planar mounting surface; and means for fastening said first bracket member and said second bracket member through said holes outside said indentations in said first bracket member and said second bracket member to the underside of the workstation;

means for adjustably positioning said underdesk monitor support assembly; and means for adjustably positioning said keyboard support assembly without interfering with the viewing and operation of a monitor supported on said underdesk monitor support assembly.

11. An assembly for supporting a monitor under the working surface of a workstation, said assembly comprising:

a support member for supporting a monitor beneath the working surface of a workstation;

means for affixing said support member beneath the working surface of a workstation;

a first linkage mechanism;

means for pivotally mounting said first linkage mechanism to a first side of said support member;

a first friction washer mounted between said first linkage mechanism and said support member;

a second linkage mechanism;

means for pivotally mounting said second linkage mechanism to a second side of said support member;

a second friction washer mounted between said second linkage mechanism and said support member;

a spring arm biasing said first friction washer and said second friction washer into engagement with said support member; and a single actuator member movable from a first position to allow said support member to freely pivot to position said support member vertically and angularly for adjusting the vertical and angular position of said support member and a second position to lock said support member in a selected position beneath the working surface of a workstation.

12. The assembly of claim 11 wherein said single actuator member includes:

cam members which disengage said first friction washer and said second friction washer from engagement with said support member as said single actuator member is moved to said first position.

13. The assembly of claim 11 wherein said adjustment means include:

spring members for biasing said support member upward.

14. The assembly of claim 11 wherein said adjustment means include:

means for adjustably positioning said support member horizontally.

* * * * *